US006049199A

United States Patent [19]

Mohr

[11] Patent Number: 6,049,199

[45] Date of Patent: Apr. 11, 2000

[54] CONTROL APPARATUS WITH REDUCED QUIESCENT CURRENT

[75] Inventor: Thomas Mohr, Buehl, Germany

[73] Assignee: Robert Bosch GmbH, Stuttgart, Germany

[21] Appl. No.: 09/284,786

[22] PCT Filed: Oct. 17, 1997

[86] PCT No.: PCT/DE97/02399

§ 371 Date: Jun. 18, 1999

§ 102(e) Date: Jun. 18, 1999

[87] PCT Pub. No.: WO98/18196

PCT Pub. Date: Apr. 30, 1998

[30] Foreign Application Priority Data

Oct. 17, 1996 [DE] Germany ..... 196 42 845

[51] Int. Cl.[7] ..... G05F 1/40

[52] U.S. Cl. ..... 323/266; 323/288; 323/289

[58] Field of Search ..... 323/283, 266, 323/282, 288, 289

[56] References Cited

U.S. PATENT DOCUMENTS

| | | | |
|---|---|---|---|
| 4,061,931 | 12/1977 | Boschert | 323/289 |
| 4,692,688 | 9/1987 | Stanojevic | 323/285 |
| 4,885,522 | 12/1989 | Konopka | 323/289 |
| 5,220,272 | 6/1993 | Nelson | 323/282 |
| 5,414,340 | 5/1995 | Gannon | 323/266 |
| 5,523,940 | 6/1996 | Wymelenberg | 363/127 |
| 5,532,914 | 7/1996 | Kageyama | 363/50 |

FOREIGN PATENT DOCUMENTS

WO 93/04422 3/1993 WIPO .

*Primary Examiner*—Shawn Riley
*Attorney, Agent, or Firm*—Kenyon & Kenyon

[57] ABSTRACT

A controller is described with a final stage which provides a defined supply voltage for a downstream electronic circuit and a circuit stage upstream from the final stage for reducing the quiescent current supplied by a voltage source. A significant reduction of the quiescent current is achieved by simple means in that the circuit stage has an electronic switch that can be set to the open or closed state by a target-value signal (SW) supplied by a control circuit.

8 Claims, 1 Drawing Sheet

CONTROL APPARATUS WITH REDUCED QUIESCENT CURRENT

FIELD OF THE INVENTION

The present invention relates to a controller with a final stage which provides a defined supply voltage for a downstream electronic circuit and a circuit stage upstream from the final stage for the reduction of the quiescent current supplied by a voltage source.

BACKGROUND INFORMATION

In controllers which are supplied on a continuous basis with battery voltage, a quiescent current draw of 100 $\mu$A to 500 $\mu$A is required. The lower value in particular cannot be achieved with conventional voltage regulators.

SUMMARY OF THE INVENTION

The object of the present invention is to make available a controller of the above type with which a reduction of the quiescent current well below conventional values can be achieved.

Thus, it is provided that the circuit stage has an electronic switch that can be set to the open or the closed condition by a target-value signal provided by the controller circuit. Because the electronic switch, which is situated upstream from the final stage that provides the supply voltage for the downstream electronic circuit, can be set to the open condition, the quiescent current can be reduced in the inactive condition of the electronic circuit to values that are significantly below 100 $\mu$A. To activate the electronic circuit, the switch is set to the closed condition.

A simple method of control is provided in that the target value signal is a pulse-wide modulated digital signal.

In a simple design of the controller for reducing the quiescent current, the switch is a transistor whose emitter is connected to the positive pole of the voltage source and whose collector is connected to the final stage. A capacitor and a diode are connected in series between an output of the controlled circuit that provides the target signal and the emitter, the cathode of the diode being connected to the terminal of the controller circuit and the anode connected to a terminal of the capacitor, the other terminal of which is connected to the emitter. The base of the transistor is connected via a resistor between the diode and the capacitor. For achieving a defined condition, according to one embodiment of the present invention, an additional resistor is connected parallel to the series connection of capacitor and diode.

If the time constants formed by the capacitor and the resistor and the pulse duration are large enough that the switch in the form of the transistor remains in the closed condition during the pulse duration in the active condition of the electronic circuit, it is assured by simple means that in the active condition of the downstream electronic circuit it is supplied with the defined supply voltage from the final stage.

In an alternative embodiment, the target-value signal can also be defined as an analog signal. The capacitor and the diode can then be omitted and the resistor is connected with its terminal that is distant from the base to the terminal for the target-value signal.

DETAILED DESCRIPTION

Figure 1:
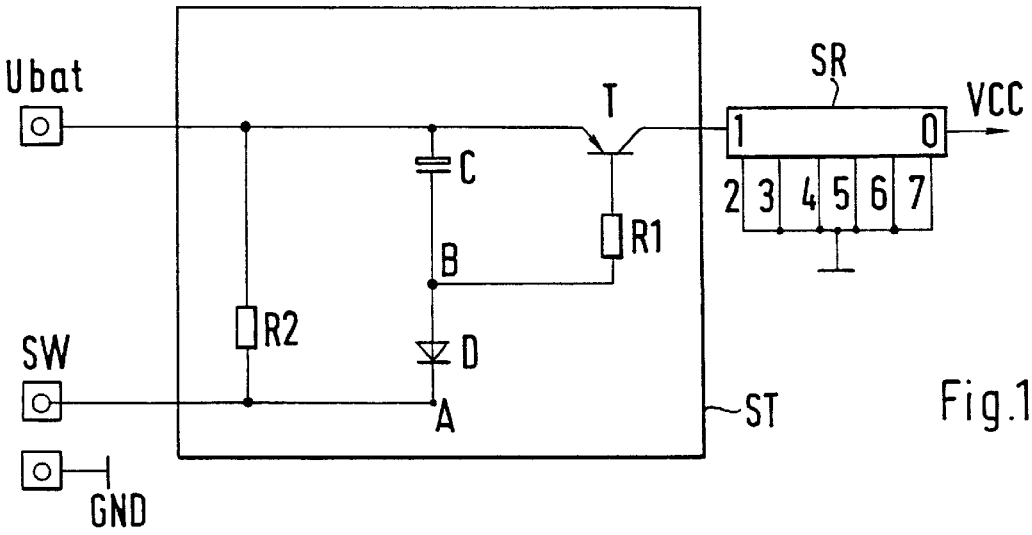
FIG. 1 shows a schematic circuit arrangement of the controller according to one embodiment of the present invention.

In FIG. 1, the circuit arrangement of a controller is schematically presented. A voltage regulator SR provides supply voltage VCC for a downstream electronic circuit, such as for example a microcontroller or microprocessor. Between a voltage source, which provides battery voltage Ubat, and voltage regulator SR, a circuit stage ST is connected with which the quiescent current of voltage regulator SR is minimized in the non-active condition of the electronic circuit.

Circuit stage ST has as an electronic switch a transistor T, the emitter of which is connected to the positive pole of the voltage source and the collector of which is connected to voltage regulator SR. Furthermore, circuit stage ST is connected on the input side, by way of example, to a terminal of an external control circuit that supplies a target-value signal SW. Between the terminal that supplies the target-value signal and the emitter of transistor T there is connected a series circuit composed of a capacitor C and a diode D, with the anode of diode D being connected to capacitor C and its cathode being connected via point A to the terminal of the control circuit. The base of transistor T is connected via a resistor R1 between capacitor C and diode D to point B. Another resistor R2 is connected parallel to the series circuit composed of capacitor C and diode D. Ground GND serves as reference potential.

Figure 2:
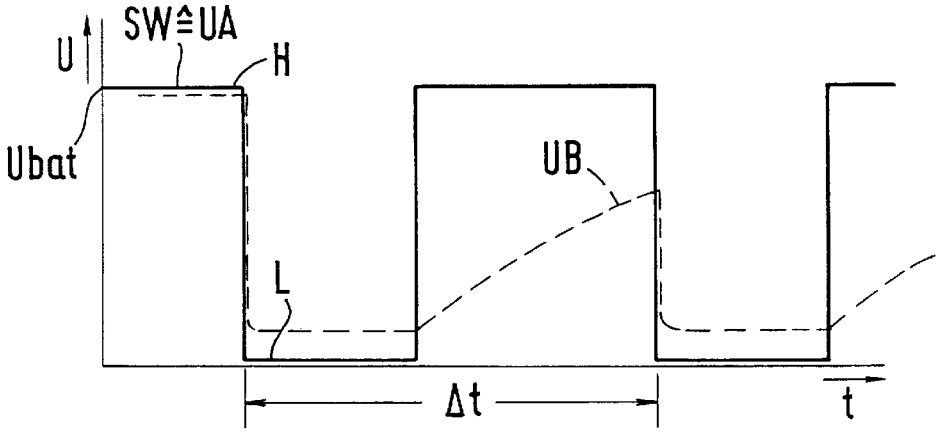
FIG. 2 shows signal curves of voltage at points A and B according to FIG. 1 according to one embodiment of the present invention.

In FIG. 2, curves of voltage U at points A and B according to FIG. 1 are plotted over time t. During the period $\Delta t$ of target-value signal SW, i.e., at point A of voltage curve UA, target-value signal SW is initially at level L and subsequently assumes level H, which is at battery voltage Ubat.

As soon as target-value signal SW drops from an initial quiescent state to L level, the voltage at point B which lies above L level by the breakover voltage of diode D, changes with only a slight time delay. From the point in time at which target-value signal SW again assumes the H level, a base current flows across resistor R1 and charges capacitor C until target-value signal SW drops again to the L level. Due to the pulse width and the time constant CR1, the voltage at point B at this point in time is still at least so far below battery voltage Ubat that transistor T remains gated and voltage regulator SR and thus the downstream electronic circuit continue to be supplied. As long as the target-value signal is at the H level, diode D is in blocking state. At the L level of target-value signal SW, the diode is in on-state.

To bring the switch in the form of transistor T into the open condition, the target value signal is placed at H level and held there. The target value is also held at battery voltage Ubat when the controller is switched off. With the controller switched on, impulse widths can be varied, for example, between 5% and 95% of the duration of the period.

The advantage achieved with circuit stage ST is the low degree of quiescent current absorption, which cannot be achieved with the known voltage regulators. Using the described circuit stage, conventional, low-cost voltage regulators can be used.

Alternatively, an analog signal can also be employed for triggering the electronic switch. In this case, capacitor C and diode D depicted in FIG. 1 can be omitted.

What is claimed is:

1. A controller comprising:

a final stage supplying a defined supply voltage for a downstream electronic circuit;

a circuit stage upstream of the final stage for reducing a quiescent current supplied by a voltage source, the circuit stage including an electronic switch; and a control circuit for supplying a target-value signal for setting the electronic switch into one of an open and a closed state, wherein the target-value signal is a pulse-width modulated digital signal.

2. The controller according to claim 1, wherein the switch includes a transistor, an emitter of the transistor connected to a positive pole of the voltage source and a collector of the transistor connected to the final stage, the controller further comprising:

a capacitor having a terminal connected to the emitter of the transistor;

a diode, wherein a cathode of the diode is connected to a terminal of the control circuit and an anode of the diode is connected to a terminal of the capacitor;

wherein the diode and the capacitor are connected in a series connection between an output of the control circuit which provides the target-value signal and the emitter;

a resistor, wherein a first terminal of the resistor is connected to a base terminal of the transistor and a second terminal of the resistor is connected to a contact between the diode and the capacitor.

3. The controller according to claim 2, further comprising a second resistor connected in parallel to the series connection of the capacitor and the diode.

4. The controller according to claim 2, wherein a time constant formed by the capacitor and the resistor and a pulse duration of the target-value signal are set at a sufficient value for the transistor to remain in a closed state during the pulse duration and while the electronic switch is in an activated state.

5. A controller comprising:

a final stage supplying a defined supply voltage for a downstream electronic circuit;

a circuit stage upstream of the final stage for reducing a quiescent current supplied by a voltage source, the circuit stage including an electronic switch; and a control circuit for supplying a target-value signal for setting the electronic switch into one of an open and a closed state, wherein the target-value signal is an analog signal.

6. The controller according to claim 1, wherein the circuit stage reduces the quiescent current supplied by the voltage source during an inactive condition of the electronic switch.

7. The controller according to claim 1, wherein the circuit stage reduces the quiescent current supplied by the voltage source below about 100 micro-amperes.

8. The controller according to claim 1, wherein the circuit stage reduces the quiescent current supplied by the voltage source significantly below 100 micro-amperes.

* * * * *

UNITED STATES PATENT AND TRADEMARK OFFICE

CERTIFICATE OF CORRECTION

PATENT NO. : 6,049,199
DATED : April 11, 2000
INVENTOR(S) : Thomas MOHR

It is certified that error appears in the above-identified patent and that said Letters Patent is hereby corrected as shown below:

In the Title, change "CONTROL APPARATUS WITH REDUCED QUIESCENT CURRENT" to -- CONTROLLER WITH QUIESCENT CURRENT REDUCTION --.

In the Abstract, line 8, delete "(SW)".

Signed and Sealed this

Fifth Day of June, 2001

Nicholas P. Godici

NICHOLAS P. GODICI

*Acting Director of the United States Patent and Trademark Office*

*Attest:*

*Attesting Officer*